United States Patent [19]

Sprenkle

[11] 4,331,182

[45] May 25, 1982

[54] DRESSING FINGER ASSEMBLY FOR AUTOMATIC WIRING MACHINES

[75] Inventor: George J. Sprenkle, Phoenixville, Pa.

[73] Assignee: Burroughs Corporation, Detroit, Mich.

[21] Appl. No.: 145,965

[22] Filed: May 2, 1980

[51] Int. Cl.[3] ..... B21F 3/04

[52] U.S. Cl. ..... 140/93 R; 140/124; 29/739; 242/7.17

[58] Field of Search ..... 140/118, 119, 122, 124, 140/149; 242/7.17; 29/4.5 B, 739

[56] References Cited

U.S. PATENT DOCUMENTS 3,213,894 10/1962 Etchison, Jr. et al. ..... 242/7.17 X 3,971,419 7/1976 Sprenkle ..... 140/124 X

*Primary Examiner*—Mark Rosenbaum

*Assistant Examiner*—Timothy V. Eley

*Attorney, Agent, or Firm*—K. R. Peterson; E. M. Chung; F. A. Varallo

[57] ABSTRACT

The present disclosure describes a dressing finger assembly of advanced design for use on automatic wiring machines. Such machines make solderless wrapped electrical connections on pluralities of planar disposed terminals. A dressing finger is employed to form predetermined wire patterns in conjunction with a wrap tool which makes the actual connection. It has been observed that the design of dressing fingers used in present day machines is such that the insulation of the wire being wrapped may be pinched and cut, thereby necessitating its replacement to avoid electrical shorting. In accordance with the present invention, the assembly comprised of a newly designed finger and supporting guide, provide the required retention and support of the wire during wrapping while eliminating the aforementioned damage to the wire.

7 Claims, 5 Drawing Figures

DRESSING FINGER ASSEMBLY FOR AUTOMATIC WIRING MACHINES

CROSS REFERENCE TO RELATED APPLICATION

To the extent that application Ser. No. 600,586, entitled "Dressing Finger for Automatic Wiring Machines", which has issued as U.S. Pat. No. 3,971,419 on July 27, 1976 in the name of George J. Sprenkle, includes a partial front view of a typical wire wrapping machine and a description of its operation as it applies to the dressing fingers and their associated wrap tools, it is referenced herein. Both the reference patent and the present application are assigned to the same assignee.

BACKGROUND OF THE INVENTION

The electrical and electronic industries routinely utilize machines for automatically attaching interconnecting wiring to terminals arranged on a panel by means of solderless wrapped connections. One such machine is the Automatic Wire-Wrap Machine, Model 14FV, manufactured by the Gardner-Denver Company. As described in the reference patent, the machine consists of movable carriages containing wrapping tool and dressing finger assemblies that are positioned to form a desired wire pattern. The dressing fingers are capable of being positioned in both the "X" and "Y" axes in small incremental distances with respect to the terminals emanating from the panel being wrapped. Also, the dressing fingers may be suitably positioned along one of said axes with respect to its associated wrap tool.

In operation, the desired wire pattern is initially formed in space above the terminals to be wrapped. Upon instruction of the machine program, the wrapping tool bits and the dressing fingers are lowered over the terminals on the panel and connections are made to the two terminals under the wrap tools. At approximately the conclusion of the wrap operation, the dressing finger is retracted into its associated sleeve or guide which pushes the wire out of the circumferential groove in the finger, which groove had supported and restrained the wire during the pattern forming stage.

It has been found that the dressing finger assembly utilized in present day machines, has a tendency under certain conditions, such as wire build-up on the wiring panel, to pinch and cut the wire insulation as the finger retracts within the guide. In such cases, the wire must be replaced to prevent possible electrical short circuits. Wire replacements on high density panels in a production environment are time consuming and costly.

It is apparent that a need exists for a dressing finger assembly of improved design which eliminates the aforementioned wire damage. The assembly of the present invention fills such a need.

SUMMARY OF THE INVENTION

In accordance with the present invention, an improved dressing finger assembly is provided for use with an associated wrap tool in an automatic wiring machine. An actual operative embodiment of the finger and its associated guide, have been successfully used on a Gardner-Denver, Model 14FV machine. The mounting of the new dressing finger assembly on the machine is readily accomplished since it is an exact replacement for the old assembly.

In the old dressing finger assembly, the wire to be patterned is retained in a circumferential groove in the free end of the finger; and the associated guide includes a longitudinal slot on opposite sides thereof formed by the run-out of its central finger-receiving bore. The new assembly differs from the old in that the finger has a generally rectangular cross section with radiused corners. A shallow slot or notch is formed at each of the corners at a predetermined distance from the free extremity of the finger. The guide has a wholly contained bore to closely fit the flattened portions and radiused corners of the finger. In contrast to the old assembly which exhibits excessive clearance between the circumferential wire groove in the finger and the guide bore, the conformance of the finger and guide in the new assembly restricts clearance considerations to the shallow wire notches in the corners of the finger only. The wire is supported on both sides of the bend during the release operation following wire wrapping. Under these conditions, the wire realizes a smaller area of clearance between finger and guide during wire release and is not exposed to any sharp features, such as those at the extremity of the slotted guide in the old assembly, with which it might become entrapped or cut.

Further, the new dressing finger assembly may be relieved as described in detail hereinafter, to provide clearance for components which may have been previously assembled to the wiring panel. Other features and advantages of the present invention will become apparent in the detailed description which follows.

DESCRIPTION OF THE PREFERRED EMBODIMENT

Figure 1:
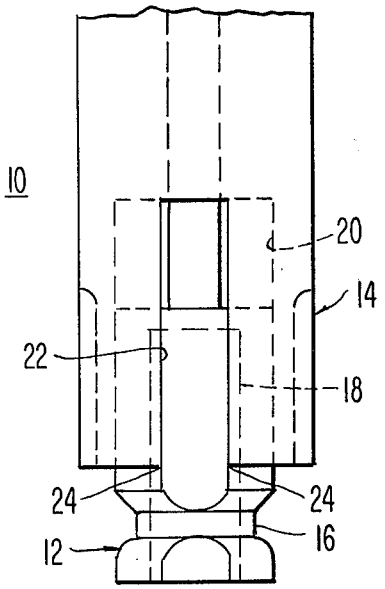
PRIOR ART Fig.1
FIG. 1 is a front view of the old dressing finger assembly.

FIG. 1 illustrates in simplified fashion the dressing finger assembly presently used on the Gardner-Denver machine, Model 14FV, which is typical of wire wrapping machines. It should be understood, however, that the invention described in detail hereinafter is not limited to use with this machine. With reference to FIG. 1, the dressing finger assembly 10 is comprised of a finger 12 and a sleeve or guide 14 for supporting the finger as it is extended beyond the extremity of the sleeve or withdrawn therein by a machine-actuated lever assembly (not shown).

The dressing finger 12 includes a circumferential groove 16 for retaining the wire during the pattern-forming operation. Additionally finger 12 has a terminal-receiving aperture 18, permitting it to be disposed over a terminal conforming to the panel grid spacing, as the ends of the patterned wire are connected to the desired terminals by wrapping tool bits (not shown). The rectangular cross section of the guide 14 containing the bore 20 is required by the machine design and terminal spacing to have a strict maximum width. Accordingly bore 20 which accommodates the dressing finger 12 results in a slot 22 being formed on opposite sides of the guide 14.

During one stage of the wire wrapping operation, a wire pattern is formed in space above the terminals to be wrapped, through the aid of one or more dressing fingers 12. Typically, the wire rests within groove 16 and bends around the finger such that approximately one-fourth of the groove is occupied by the wire. Subsequently, upon instruction of the machine program, the wrapping tool bits and the dressing fingers are lowered a prescribed distance over the terminals on the panel and connections are made simultaneously to the two terminals under the respective wrap tools. At the conclusion of the wrap operation, the aforementioned lever assembly retracts the dressing finger 12 into the guide 14 causing the latter to push the wire out of the groove 16. This action permits the wire to remain on substantially the same plane as the wire wraps being accomplished.

It has been found that in the last-mentioned portion of the wrap cycle, and particularly where there has been a wire build up on the wiring panel, the finger and guide design in FIG. 1 is such that the wire insulation is often pinched and cut, necessitating the replacement of the wire. The damage to the wire is attributed to the clearance between the wire-retaining groove 16 in the finger 12 and the bore 20 of guide 14. It is in this area that the wire insulation can become trapped and cut as the finger 12 is retracted within the guide 14. More particularly, damage is most likely to occur in the area at the extremity of each of the slots 22, where razor-like points 24 tend to cut and abrade the wire insulation.

Figure 2:
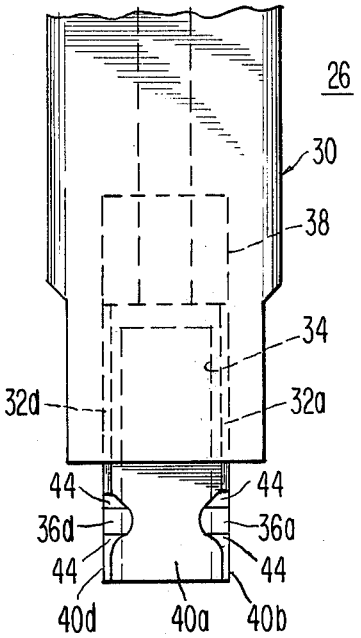
FIG. 2 is a front view of the new dressing finger assembly of the present invention.
Figure 3:
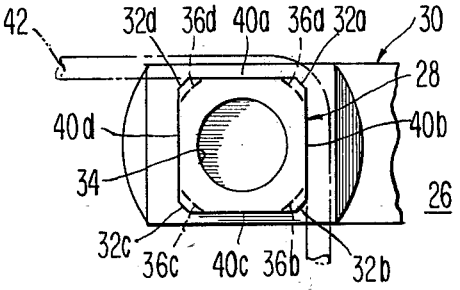
FIG. 3 is an end view of the assembly of FIG. 2.

Reference should now be made to the respective front and end views of FIGS. 2 and 3, illustrating a dressing finger assembly 26 in accordance with the present invention. This last assembly is comprised of a dressing finger 28 and a guide 30, which cooperate in performing the patterning function of the assembly of FIG. 1, while eliminating the detrimental effects of the latter. The new dressing finger 28 has a substantially square cross-sectional area with radiused corners 32*a*–32*d*. A centrally disposed longitudinal terminal-accommodating aperture 34 is also present in the finger. Wire notches 36*a*–36*d* are formed in the respective corners of the finger 28, thereby providing retention of the wire only at the corners where it is needed.

The guide 30 has a wholly contained longitudinal bore 38 which closely matches the shape of the flat sections 40*a*–40*d* and radiused corners 32*a*–32*d* of the finger. The conformable design of finger and guide restricts the clearance between the wire notches 36*a*–36*d* and guide 30 to the corners only. This is in sharp contrast to the finger of FIG. 1, where fully one-fourth of the circumferential groove 16 is occupied by the wire. Moreover, in the assembly of FIGS. 2 and 3, the wire 42 is supported by the flat sections 40*a* and 40*b* on both sides of the wire bend in notch 36*a* at the common corner 32*a*, during the pattern-forming operation. Because of this arrangement, the wire 42 is exposed to only a small area of clearance between finger 28 and guide 30 as the wire is slipped over the free extremity of the finger by interference with the surface of the guide, during retraction of the finger. Moreover, the wire is at no time subjected to any sharp features with which it might become entrapped or cut. To facilitate the removal of the wire 42 from a notch such as that designated 36*a*, the sides 44 of the latter are sloped outward, that is, from the arcuate bottom of the notch 36*a* to the outer surface of the corner 32*a* of the finger, such that the notch exhibits a substantially truncated V-shaped configuration as seen in FIG. 2.

As illustrated in FIG. 3, the wire 42 is shown in a typical dress configuration wherein it is drawn across the top flat 40*a* of the finger and down along the side flat 40*b* in a clockwise direction, where it bends and is restrained in notch 36*a*. In the opposite case, the wire 42 might be drawn along the bottom flat 40*c* of the finger and up along side flat 40*b* in a counterclockwise direction, where it is restrained in notch 36*b*. Under these conditions, the remaining notches 36*c* and 36*d* are not needed for wire patterning. However, their presence on the finger is desirable because it eliminates the necessity of having an operator orient the finger in the guide with respect to the position of the notches prior to the wrapping operation. Also this arrangement has the additional benefit of extending the life of the dressing finger since the random placement of the finger within the guide will distribute operational wear over all four notches.

Figure 4:
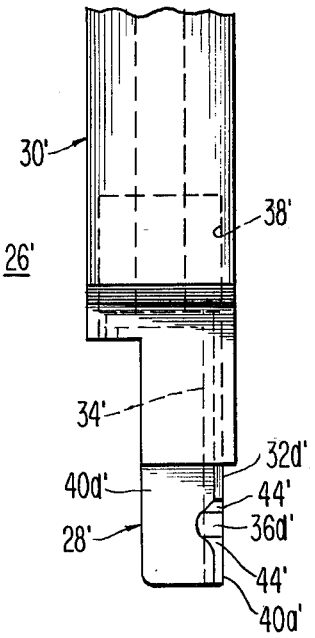
FIG. 4 is a side view of a dressing finger assembly embodying the inventive concepts of the assembly of FIG. 2 but cut-away or relieved to accommodate electrical components already mounted on the wiring panel.
Figure 5:
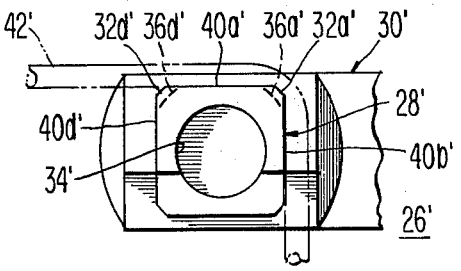
FIG. 5 is an end view of the assembly of FIG. 4.

FIGS. 4 and 5 depict respectively side and end views of a dressing finger assembly 26′ which employs the improved design described hereinbefore, but is modified to provide clearance between the assembly and electrical components already mounted on the wiring panel. Reference characters similar to those used in FIGS. 2 and 3, but bearing a prime superscript, are used to identify like items. As seen in the last mentioned figures, and with additional reference to FIGS. 2 and 3, a longitudinal portion of the dressing finger 28′ has been cut away, eliminating one of the flat sections corresponding to 40*c* in FIG. 3 and the corners 32*b* and 32*c* on opposite sides thereof. Also, the terminal-receiving aperture 34′ is now open along the cutaway portion. The remaining flat section 40*a*′, opposite to the one removed, retains the pair of wire receiving notches 36*a*′ and 36*d*′. At least a portion of the guide 30′ adjacent the cutaway portion of the finger 28′ has also been removed. As a result of the cutaway portions of dressing finger 28′ and guide 30′, the remaining structure adjacent sides 40*d*′, 40*a*′ and 40*b*′ of dressing finger 28′ and the structure of guide 30′ which is contiguous to the last mentioned sides, exhibit respective substantially U-shaped cross-sections as seen in FIG. 5. A wire 42′ dressed as shown in FIG. 5 utilizes notch 36*a*′, while an oppositely disposed pattern (not shown), as described in connection with FIG. 3, would utilize an opposite-hand assembly. That is, the cutaway section of the finger 28′ would involve side 40*a*′ and notches 36*a*′ and 36*d*′ while a side corresponding to 40*c* in FIG. 3 and notches 36*b* and 36*c* in the last mentioned figure, would be retained. Additionally, a portion of guide 30′ would be cut away in the area adjacent to the cutaway section of the finger 28′. The wire 42′ would then be held in a notch homologous to that labeled 36*b* in FIG. 3. Having been relieved as shown in FIGS. 4 and 5, the assembly is able to be positioned over the right-angle lead terminations of discrete components or the extremities of high profile packages such as DIP's. In applications involving high density panels, the provision of additional clearance eliminates premature wire release, finger, guide or component damage. Also, inadvertent contact of the finger assembly with a mounted component could force it off its true course, thereby causing damage to adjacent previously installed wiring.

In conclusion, it should be noted that although the previous description outlines a specific design for a particular machine, the basic principles taught herein may be applied to other similar automatic machines which nevertheless differ somewhat in construction or operation. The dressing finger assembly of the present invention offers a convenient, economical, time saving means of minimizing wire damage during wiring operations. Changes and modification of the assembly may be needed to suit particular requirements. Such variations as are within the skill of the designer, and which do not depart from the true scope and spirit of the invention are intended to be covered by the following claims.

What is claimed is:

1. A dressing finger assembly for use on automatic wiring machines to provide a predetermined pattern in a wire being connected to a terminal, comprising:

a dressing finger having a portion of its exterior surface formed of at least first and second parallel spaced-apart planar sections and a third planar section oriented at right angles thereto, the extremities of said third section being joined respectively to first extremities of said first and second sections by a respective first pair of arcuate corner sections, said dressing finger further having a longitudinally disposed terminal-receiving aperture;

a notch formed in at least one of said corner sections at a predetermined distance from the extremity of said dressing finger;

said wire being supported by the surfaces of the pair of planar sections joined by the last-mentioned corner section and being held in said notch during the pattern-forming operation.

2. A dressing finger assembly as defined in claim 1 further including a guide having a longitudinally disposed aperture for slidably supporting said dressing finger, said opening having cross-sectional dimensions substantially conforming to those of the exterior surface of said dressing finger.

3. A dressing finger assembly as defined in claim 2 further characterized in that a longitudinal opening into said terminal-receiving aperture of said dressing finger is provided opposite to said third planar section, said guide having at least in a portion thereof, a corresponding adjacent longitudinal opening, the last mentioned openings causing both said guide and said dressing finger to exhibit respective substantially U-shaped cross-sections, and providing maximum clearance for the use of said dressing-finger assembly.

4. A dressing finger assembly as defined in claim 3 characterized in that respective wire-holding notches are formed in both said first pair of arcuate corner sections.

5. A dressing finger assembly as defined in claim 2 further characterized in that said exterior surface of said dressing finger includes a fourth planar section parallel to said third planar section and joined to respective second extremities of said first and second sections by a second pair of arcuate corner sections, thereby causing said dressing finger to assume a substantially rectangular cross section with arcuate corners;

said longitudinal aperture in said guide being wholly contained there within.

6. A dressing finger assembly as defined in claim 4 characterized in that respective wire-holding notches are formed in both said first and said second pair of arcuate corner sections.

7. A dressing finger assembly as defined in claims 5 or 4 wherein each of said notches exhibits a substantially truncated V-shaped configuration, wherein an arcuate base region slopes outward to meet the exterior surface of a corner section, the sloped portion of the notch facilitating the release of said wire at the conclusion of the wire-forming operation.

* * * * *